US006339280B1

(12) United States Patent
Miyamoto et al.

(10) Patent No.: US 6,339,280 B1
(45) Date of Patent: Jan. 15, 2002

(54) FLASH LAMP WITH MIRROR

(75) Inventors: Makoto Miyamoto; Hiroyuki Amano, both of Shizuoka-ken (JP)

(73) Assignee: Hamamatsu Photonics K.K., Hamamatsu (JP)

( * ) Notice: Subject to any disclaimer, the term of this patent is extended or adjusted under 35 U.S.C. 154(b) by 0 days.

(21) Appl. No.: 09/403,933

(22) PCT Filed: Apr. 30, 1998

(86) PCT No.: PCT/JP98/01966

§ 371 Date: Oct. 28, 1999

§ 102(e) Date: Oct. 28, 1999

(87) PCT Pub. No.: WO98/49713

PCT Pub. Date: Nov. 5, 1998

(30) Foreign Application Priority Data

Apr. 30, 1997 (JP) ..... 9-112897

(51) Int. Cl.[7] ..... H01J 61/80; H01J 61/30

(52) U.S. Cl. ..... 313/113; 313/567; 313/581; 315/335; 315/337; 315/339; 315/261

(58) Field of Search ..... 313/113, 335, 313/337, 339, 567, 581; 315/261, 339, 335, 337; 361/117, 120

(56) References Cited

U.S. PATENT DOCUMENTS

| | | | | |
|---|---|---|---|---|
| 3,766,421 A | | 10/1973 | Bonazoli et al. | 313/113 |
| 4,020,379 A | | 4/1977 | Manning | 313/220 |
| 4,179,037 A | | 12/1979 | Chan et al. | 220/2.3 R |
| 4,658,179 A | | 4/1987 | Roberts | 313/113 |
| 4,754,194 A | * | 6/1988 | Feliciano et al. | 313/581 X |
| 5,128,596 A | | 7/1992 | Shimazu et al. | 315/335 |
| 5,336,970 A | * | 8/1994 | Einbinder | 313/581 X |

FOREIGN PATENT DOCUMENTS

| | | |
|---|---|---|
| JP | 48-33938 | 10/1973 |
| JP | 53-70580 | 6/1978 |
| JP | 56-50384 | 11/1981 |
| JP | 3-269949 | 12/1991 |
| JP | 7-120518 | 12/1995 |

* cited by examiner

*Primary Examiner*—Ashok Patel
(74) *Attorney, Agent, or Firm*—Morgan, Lewis & Bockius LLP

(57) ABSTRACT

In a flash lamp, a mirror structure (20, 30, 40) is fixed at an inner end portion of an exhaust pipe (21, 34, 44) secured to a center of a stem (6) disposed at a bottom portion of an envelope (H). An arc emission part (S) is located at a focal position of a rounded mirror surface 24.

5 Claims, 3 Drawing Sheets

FLASH LAMP WITH MIRROR

TECHNICAL FIELD

The present invention relates to a flash lamp equipped with a mirror, utilized as a light source for spectroscopy, emission analysis or the like, a stroboscopic light source, a light source for processing high-quality images, or the like.

BACKGROUND ART

A conventional technique in such a field is disclosed in Japanese Patent Publication No. HEI 7-120518. In the mirror-equipped f lash lamp described in the above-mentioned publication, a cathode and an anode are disposed facing each other inside a bulb made of glass, the front end of a trigger probe electrode is located between the cathode and the anode, and an inert gas, such as xenon or argon, is encapsulated in the bulb. Further, for attaining high-output light, an ellipsoidal mirror is disposed inside the bulb, and the cathode is inserted in an opening formed in the bottom part of the ellipsoidal mirror, whereby an arc emission point is formed at a first focal point inside the ellipsoidal mirror. By the provision of such an ellipsoidal mirror inside the bulb, a high-output flash lamp is produced.

DISCLOSURE OF THE INVENTION

Due to the above-mentioned configuration, however, the following problem exists in the conventional mirror-equipped flash lamp.

Namely, since the bottom part of the ellipsoidal mirror is formed with an opening, light reflected by the ellipsoidal mirror forms a dark portion in its irradiation area under the influence of the opening, thus lacking uniformity. As a result, when irradiation light is to be introduced into a small-diameter fiber or slit, there have been cases where shortages or inconsistencies in quantity of light occur. While Japanese Patent Publication No. SHO 56-50384 also discloses a xenon lamp equipped with a mirror, the mirror in this case is also formed with an opening for receiving a pedestal for supporting an electrode.

For solving the above-mentioned problem, it is an object of the present invention, in particular, to provide a mirror-equipped flash lamp adapted to generate uniform light whose irradiation inconsistencies are very small.

The mirror-equipped flash lamp in accordance with the present invention is a flash lamp in which an arc emission is generated by cooperation of a cathode, an anode, a trigger probe electrode, and a sparker electrode which are secured by way of stem pins to a stem disposed in an envelope having a light projection window, and this emission is emitted from the light projection window; wherein a mirror structure, contained in the envelope, having a rounded mirror surface facing the light projection window is contained in the envelope between a stem pin for the cathode and a stem pin for the anode and is secured to a leg rising from the stem, the mirror structure and an exhaust port of an exhaust pipe secured to a center of the stem are separated from each other, and an arc emission part is disposed at a focal position of the rounded mirror surface.

In this mirror-equipped flash lamp, when a predetermined voltage is applied between the cathode and the anode, and a trigger voltage is applied to the trigger probe electrode and the sparker electrode, a discharge occurs at the trigger probe electrode and, along with this discharge, a main discharge of an arc occurs between the cathode and the anode. The resulting emission is reflected by the mirror surface, so as to be emitted from the light projection window. Since such a mirror surface is formed as a rounded mirror surface, and a mirror structure is contained between a stem pin for the cathode and a stem pin for the anode, it is not necessary to bore a hole in the rounded mirror surface, the whole mirror surface can be used effectively as a reflecting surface, the reflection characteristics inherent in the mirror surface can fully be utilized, and the arc emission part can be placed at the focal position of the rounded mirror surface while preventing the stem pins from penetrating through the rounded mirror surface. Also, since the exhaust port of the exhaust pipe and the mirror structure are separated from each other, the exhaust port of the exhaust pipe facing inside the envelope would not be closed by the mirror structure.

Preferably, in this case, the mirror structure comprises a mirror portion made of glass having the rounded mirror surface, and a mirror holder surrounding the mirror portion. When such a configuration is employed, in the forming of the rounded mirror surface, the surface processing is easier than that in metals such as aluminum, thereby yielding a surface which not only can be made at a lower manufacturing cost but also has a low surface roughness and high surface precision. Also, when aluminum is vapor-deposited on a glass surface to form a rounded mirror -surface, a firm specular surface would be formed on the glass surface, whereby a highly durable rounded mirror surface can be obtained.

BEST MODE FOR CARRYING OUT THE INVENTION

In the following, preferred embodiments of the mirror-equipped flash lamp in accordance with the present invention will be explained in detail with reference to the drawings.

Figure 1:
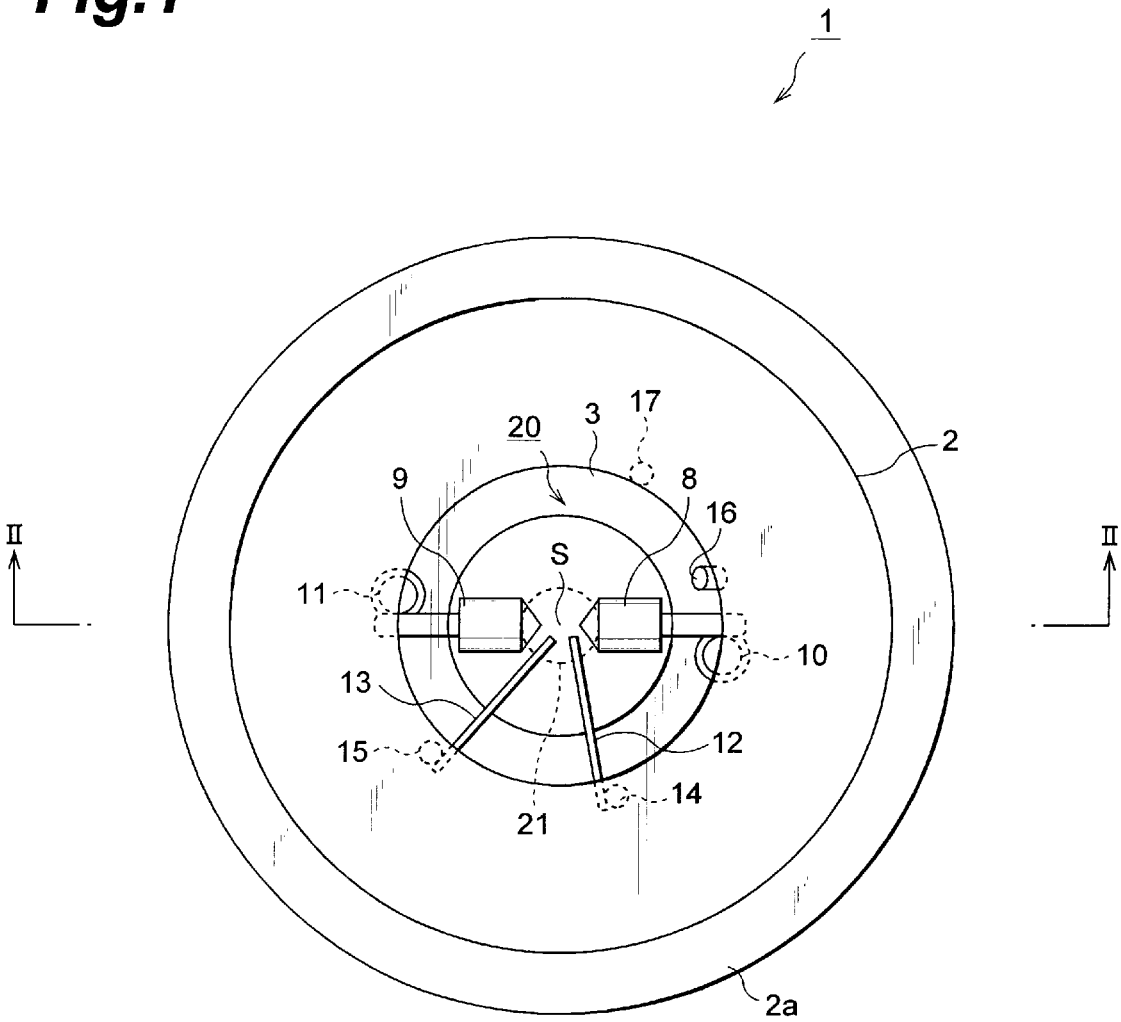
FIG. 1 is a plan view of an embodiment of the mirror-equipped flash lamp in accordance with the present invention.
Figure 2:
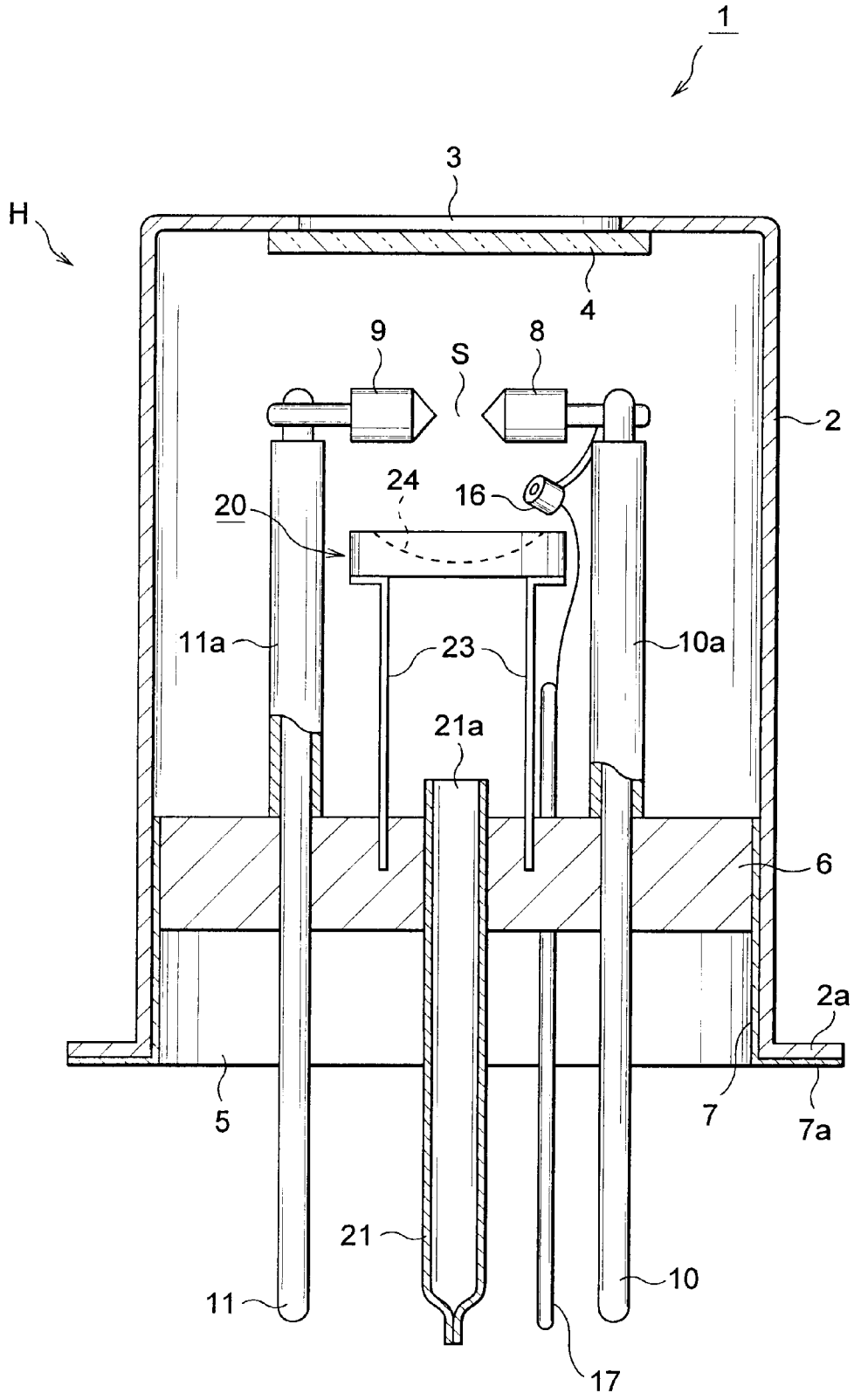
FIG. 2 is a sectional view taken along the line II—II of FIG. 1.

FIG. 1 is a plan view showing the appearance of a mirror-equipped flash lamp in accordance with the present invention, whereas FIG. 2 is a sectional view taken along the line II—II of FIG. 1. The mirror-equipped flash lamp 1 shown in these drawings has a cylindrical side tube 2 made of covar metal, a circular first opening 3 is formed at one end of the side tube 2, and a light projection window 4 made of sapphire glass is secured to the side tube 2 so as to close the first opening 3. Further, a circular second opening 5 is formed at the other end of the side tube 2, and a disk-shaped stem 6 made of covar glass is secured to the side tube 2 so as to close the second opening 5. Also, a cylindrical stem holder 7 made of covar metal is fused to the peripheral side face of the stem 6, so that the flange portion 7*a* of the stem holder 7 and the flange 2*a* of the side tube 2 can be arc-welded to each other, thereby making it easier for the stem 6 and the side tube 2 to be secured to each other. Thus, a hermetic type envelope H of the flash lamp 1 is constructed.

Further, a cathode 8 and an anode 9 which are adapted to cause an arc discharge are disposed inside the envelope H, the cathode 8 is fixed at the front end of a stem pin 10 which is secured so as to penetrate through the stem 6 and extends in the tube axis direction, and this stem pin 10 is covered with an electrically insulating pipe 10*a* made of ceramics. Similarly, the anode 9 is fixed at the front end of a stem pin 11 which is secured so as to penetrate through the stem 6 and extends in the tube axis direction, and is covered with an electrically insulating pipe 11*a* made of ceramics. The cathode 8 and the anode 9 are positioned directly below the light projection window 4, and oppose each other on a line in the horizontal direction (direction perpendicular to the tube axis). Also, an arc emission part S formed between the front end of the cathode 8 and the front end of the anode 9 is caused to align with the tube axis.

Also, inside the envelope H, two trigger probe electrodes 12, 13 are disposed such that their front ends are located between the cathode 8 and the anode 9, whereas these electrodes 12, 13 are secured to the stem 6 with the aid of stem pins 14, 15. Further, a sparker electrode 16 is disposed inside the envelope H, and is secured to the stem 6 with the aid of a stem pin 17. The inside of the envelope H is kept at a high pressure, with xenon gas as an example of the inert gas being encapsulated therein.

When a predetermined voltage is applied between the cathode 8 and the anode 9 by way of the cathode stem pin 10 and anode stem pin 11, and a trigger voltage is applied to the trigger probe electrodes 12, 13 and the sparker electrode 16 by way of the stem pins 14, 15, 17, a discharge occurs at the trigger probe electrodes 12, 13 and, along with this discharge, a main discharge of an arc occurs between the cathode 8 and the anode 9. The emission at this time is reflected by a mirror structure 20 which will be explained later, so as to be emitted from the light projection window 4.

Figure 3:
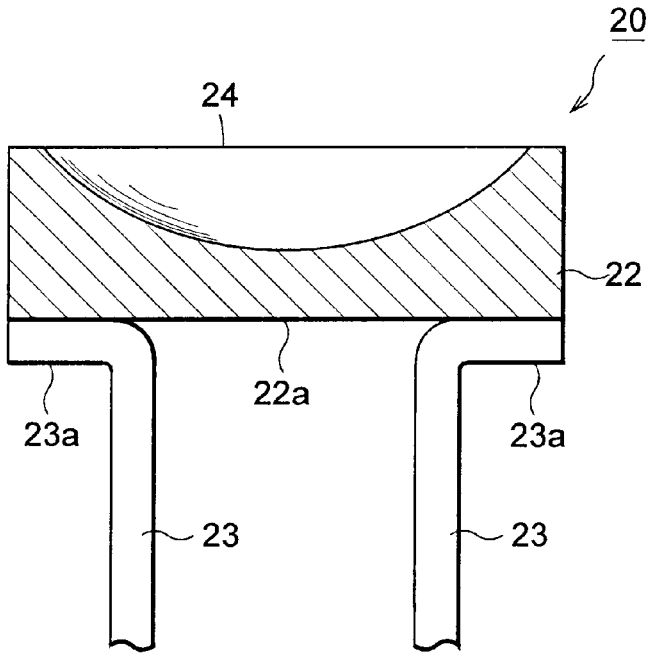
FIG. 3 is a sectional view showing the mirror structure and exhaust pipe employed in the flash lamp shown in FIG. 1.

As shown in FIG. 3, this mirror structure 20 has a metal substrate 22 made of aluminum, copper, or the like, which is formed like a dish. The top face of the substrate 22 is formed with a mirror surface 24, facing the light projection window 4, shaped into a rounded mirror surface while constituting a concave mirror. Here, the rounded mirror surface refers to a mirror surface made of a curved surface with a constant radius of curvature having a single focal point. This rounded mirror surface 24 is formed by vapor-depositing aluminum onto the metal substrate 22. When the rounded mirror surface 24 is employed, the arc emission part S (see FIG. 2) located between the cathode 8 and the anode 9 can align with the focal position (center of curvature) of the mirror surface 24, thus allowing the mirror surface 24 to reliably collect light.

As shown in FIG. 2, the mirror structure 20 is disposed between the arc emission part S and the stem 6 and is contained between the cathode stem pin 10 and the anode stem pin 11, so as to be positioned directly below the arc emission part S. For enabling such an arrangement, the mirror structure 20 is fixed at the front end of each of pin-shaped legs 23 embedded in the stem 6. Specifically, an L-shaped front end portion (inner end portion) 23*a* of each leg 23 is secured to the bottom face 22*a* of the substrate 22 of the mirror structure 20 by welding.

Further, an exhaust pipe 21 made of covar metal is disposed between the legs 23, and extends in the tube axis direction so as to penetrate through the center of the disk-shaped stem 6. Also, the exhaust port 21*a* of the exhaust pipe 21 projects so as to open inside the envelope H, and is disposed at a position separate from the mirror structure 20, whereby the exhaust port 21*a* of the exhaust pipe 21 facing inside the envelope H would not be closed by the mirror structure 20. Therefore, at the time of assembling the flash lamp 1, the operations of discharging the air from inside the envelope H and introducing an inert gas (e.g., xenon gas) into the envelope H can reliably be achieved by the exhaust port 21*a*.

When such a configuration is employed, the rounded mirror surface 24 can be made as a complete surface without necessitating an opening to be formed therein. Thus, post-processing such as boring a hole in the rounded mirror surface 24 is not necessary, the whole rounded mirror surface 24 can be used effectively as a reflecting surface, and the reflection characteristics inherent in the rounded mirror surface 24 can fully be utilized.

Another embodiment of the mirror-equipped flash lamp in accordance with the present invention will now be explained in brief. Here, constituents identical or equivalent to those in the above-mentioned embodiment will be referred to with numerals or letters identical to each other.

Figure 4:
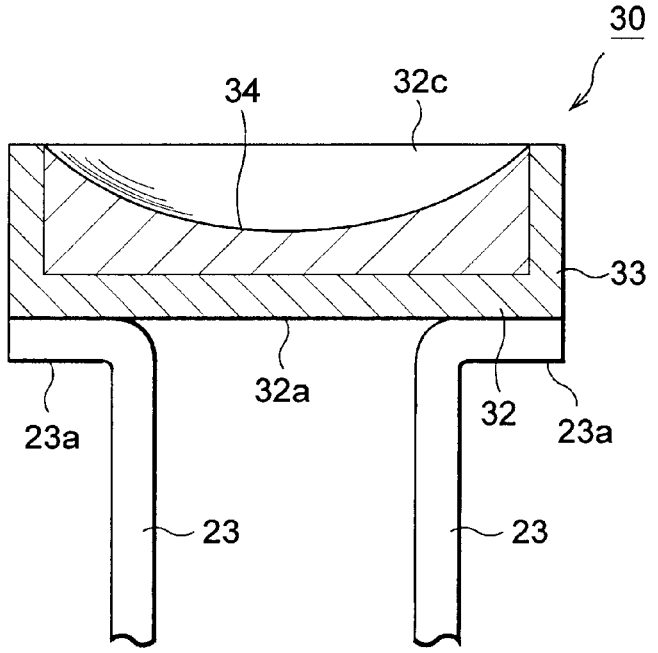
FIG. 4 is a sectional view showing a modified example of the mirror structure.

As shown in FIG. 4, the mirror structure 30 is constructed as a dividable type and has a cup-shaped mirror holder 32 made of stainless, and this mirror holder 32 is formed like a cylinder having a bottom face 32*a* to which an L-shaped front portion (inner end portion) 23*a* of each leg 23 is secured by welding. A disk-shaped mirror portion 33 is tightly fitted in the mirror holder 32 in a concentric fashion. The mirror portion 33 is made of a glass material and has such a diameter that it can be inserted into the mirror holder 32 from its opening 32*c*. Also, a rounded mirror surface 34 facing the light projection window 4 is formed at the top face of the mirror portion 33 and constitutes a concave mirror. Here, the rounded mirror surface refers to a mirror surface made of a curved surface with a constant radius of curvature having a single focal point. This rounded mirror surface 34 is formed by vapor-depositing aluminum onto a glass surface.

When glass is thus employed in the mirror portion 33, in the forming of the rounded mirror surface 34, the surface processing is easier than that in metals such as aluminum, thereby yielding the rounded mirror surface 34 which not only can be made at a lower manufacturing cost but also has a low surface roughness and high surface precision. Also, when aluminum is vapor-deposited on glass to form the rounded mirror surface 34, a firm specular surface would be formed, whereby the highly durable rounded mirror surface 34 can be obtained. With the aid of an adhesive, the mirror portion 33 made of glass is secured to the mirror holder 32 made of a metal. When an unshown ring body or pawl piece is utilized, however, the mirror portion 33 is held within the mirror holder 32 as being pressed from thereabove.

The present invention is not limited to the above-mentioned various embodiments. For example, the legs 23 may be shaped like a leaf instead of a pin. Further, the mirror portion 33 may be constructed so as to be embedded in the mirror structure 20.

As a consequence of the foregoing configuration, the mirror-equipped flash lamp in accordance with the present invention can yield the following effects. Namely, since a mirror structure having a rounded mirror surface, contained in an envelope, facing a light projection window is contained between a stem pin for a cathode and a stem pin for an anode inside the envelope and is secured to a leg rising from a stem, while the mirror structure and an exhaust port of an exhaust pipe secured to a center of the stem are separated from each other, an arc emission part being disposed at a focal position of the rounded mirror surface, a structure in which the rounded mirror surface is free of holes can be attained, and uniform light can be generated with very small irradiation inconsistencies.

Industrial Applicability

The mirror-equipped flash lamp in accordance with the present invention can be utilized as a light source for spectroscopy, emission analysis or the like, a stroboscopic light source, a light source for processing high-quality images, or the like.

What is claimed is,:

1. A flash lamp comprising:

an exhaust pipe penetrating through a stem of an envelope;

a pair of stem pins extending from said stem;

a mirror structure, disposed between said stem pins and secured to said stem, having a concave mirror for reflecting an arc emission between an anode and a cathode respectively supported by said stem pins and emitting said emission from a window of said envelope, said concave mirror being disposed between an inner end portion of said exhaust pipe and said window; and a sparker electrode disposed inside said envelope for causing a discharge, said sparker electrode being located at a point outside of a space bounded by the concave surface of said concave mirror and said window.

2. A flash lamp according to claim 1, wherein said mirror structure comprises a mirror portion made of glass having said concave mirror, and a mirror holder surrounding said mirror portion.

3. A flash lamp according to claim 1, wherein said sparker electrode is secured to said stem with an aid of a stem pin.

4. A flash lamp according to claim 1, wherein the flash lamp is configured such that, when a predetermined voltage is applied between said cathode and said anode, and a trigger voltage is applied to trigger probe electrodes arranged in said envelope and said sparker electrode, a discharge occurs at the trigger probe electrodes and, along with this discharge, a main arc discharge occurs between said cathode and said anode.

5. A flash lamp comprising:

an exhaust pipe penetrating through a stem of an envelope;

a pair of stem pins extending from said stem; and a mirror structure, disposed between said stem pins and secured to said stem, having a concave mirror for reflecting an arc emission between an anode and a cathode respectively supported by said stem pins and emitting said emission from a window of said envelope, said concave mirror being disposed between an inner end portion of said exhaust pipe and said window, the mirror structure comprising a mirror portion made of glass having said concave mirror and a mirror holder surrounding said mirror portion.

* * * * *